US009648944B2

(12) United States Patent
Babrow

(10) Patent No.: US 9,648,944 B2
(45) Date of Patent: May 16, 2017

(54) SELF MOISTENING BRUSH

(71) Applicant: Vernon Kennedy Babrow, The Valley (AI)

(72) Inventor: Vernon Kennedy Babrow, The Valley (AI)

( * ) Notice: Subject to any disclaimer, the term of this patent is extended or adjusted under 35 U.S.C. 154(b) by 40 days.

(21) Appl. No.: 14/522,612

(22) Filed: Oct. 24, 2014

(65) Prior Publication Data

US 2016/0113385 A1 Apr. 28, 2016

(51) Int. Cl.
*A46B 11/00* (2006.01)

(52) U.S. Cl.
CPC ..... *A46B 11/0062* (2013.01); *A46B 11/0055* (2013.01); *A46B 11/0079* (2013.01); *A46B 11/0096* (2013.01); *A46B 2200/202* (2013.01)

(58) Field of Classification Search
CPC ..... A46B 11/001; A46B 11/0013; A46B 11/0041; A46B 11/0055; A46B 11/0062; A46B 11/0079; A46B 11/0086
USPC ..... 401/176, 192
See application file for complete search history.

(56) References Cited

U.S. PATENT DOCUMENTS 203,256 A * 5/1878 Frobisher ..... 15/184
838,241 A * 12/1906 Conners ..... A46B 11/0013 15/176.2
945,238 A * 1/1910 Lange ..... A46B 11/0013 401/270
950,074 A * 2/1910 Miller ..... A46B 11/0013 401/270
1,060,046 A * 4/1913 Wells ..... A46B 11/0013 401/276
1,226,368 A * 5/1917 Raeburn ..... A46B 11/0013 401/278
1,571,338 A * 2/1926 Kratochvil ..... A46B 11/0093 15/248.1
1,733,144 A * 10/1929 Walker ..... A46B 11/0013 15/184
2,165,508 A * 7/1939 Rieber ..... A46B 11/0013 222/485
4,225,254 A * 9/1980 Holberg ..... A46B 5/02 141/18
5,483,721 A * 1/1996 Caldwell ..... A46B 11/06 15/160
6,082,921 A * 7/2000 Caldwell ..... A46B 11/0013 15/205.2
6,213,667 B1 * 4/2001 Isaac ..... A46B 11/063 401/282
7,607,852 B2 * 10/2009 Washington ..... A45D 34/042 401/176

(Continued)

*Primary Examiner* — Jennifer C Chiang
*Assistant Examiner* — Bradley Oliver

(57) ABSTRACT

The invention discloses a paint brush comprising a hollow body having a first end opposing a second end and an inside and an outside. The invention also includes a handle having an inside and an outside, wherein the first end of the body is connected to the handle, and wherein the outside of the second end of the body is adapted for receiving a plurality of bristles. A plurality of bristles is attached to the outside of the second end of the body and a cavity is defined by the inside of the body and handle. The cavity is connected to the outside of the second end of the body by at least one channel. The invention also includes a removable cap covering an opening at a terminating end of the handle.

17 Claims, 5 Drawing Sheets

(56) References Cited

U.S. PATENT DOCUMENTS

| | | | | |
|---|---|---|---|---|
| 2004/0240929 | A1* | 12/2004 | Watson | B05C 17/002 401/286 |
| 2005/0025561 | A1* | 2/2005 | Larsen | A46B 11/0062 401/291 |
| 2007/0292197 | A1* | 12/2007 | Peterson | A46B 5/0095 401/183 |
| 2008/0095571 | A1* | 4/2008 | Geigle | A46B 17/06 401/289 |
| 2014/0140753 | A1* | 5/2014 | Hesse | A46B 11/00 401/268 |

* cited by examiner

SELF MOISTENING BRUSH

CROSS-REFERENCE TO RELATED APPLICATIONS

Not Applicable

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The technical field relates generally to the field of brushes, and more specifically to paint brushes.

BACKGROUND

Many brushes are available on the market today. When painting, a person typically dips a brush into a bucket or container of paint, varnish, etc. and applies the paint onto the surface intended to be painted. When painting for a long period of time, the bristles of the brush become exposed to air which causes the paint, varnish, etc. to begin to dry. When this happens the brush bristles become "tight" and less flexible. When the bristles become tight, this results in the paint becoming clogged along the bristles and along the surface that is intended to be painted. For example, when a painting-job is first begun and a new brush is used, for the first few strokes of the brush, the plurality of bristles flex or bend well such that the paint, varnish, etc. is applied smoothly and evenly. As a result of the paint being applied smoothly and evenly, the appearance of the paint on the surface is aesthetically pleasing. However, as time progresses the brush bristles starts to "tighten up", or lose their ability to bend, and the paint, varnish, etc., is no longer able to be applied correctly causing a noticeable difference between the finish of the surfaces applied with a new brush compared to a brush that has been used for a longer period of time. If the bristles tighten up, then the paint or varnish will tend to clog and run preventing a smooth finish.

To solve this problem in the past, people have added to the varnish or paint some type of paint thinner or alternative to paint thinner. However, several problems exist when adding substances directly to paint or other finishes. For example, adding a thinning agent to paint, varnish, etc. increases the amount of labor and time involved to complete the task of painting. This is because when the paint, varnish, etc. has a thinning agent added, the paint, varnish, etc. becomes thinner. This results in having to increase the amount of coats of paint to produce the same finish as if no thinner was applied. Because of the increased amount of coats required, more labor, time and resources are needed. Additionally, having to purchase paint thinner to add to the paint or varnish increases the cost of completing the job of painting a surface. Additionally, sometimes the paint thinner added to the paint in this manner does not protect the portions of the bristles closest to the body or handle of the brush.

Therefore, a need exists for improvements over the prior art.

SUMMARY

This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claimed subject matter's scope.

In one embodiment, the invention discloses a paint brush comprising a hollow body having a first end opposing a second end and an inside and an outside. The invention also includes a handle having an inside and an outside, wherein the first end of the body is connected to the handle, and wherein the outside of the second end of the body is adapted for receiving a plurality of bristles. A plurality of bristles is attached to the outside of the second end of the body and a cavity is defined by the inside of the body and handle. The cavity is connected to the outside of the second end of the body by at least one channel. The invention also includes a removable cap covering an opening at a terminating end of the handle.

BRIEF DESCRIPTION OF THE DRAWINGS

The subject matter, which is regarded as the disclosed embodiments, is particularly pointed out and distinctly claimed in the claims at the conclusion of the specification. The foregoing and other features and also the advantages of the disclosed embodiments will be apparent from the following detailed description taken in conjunction with the accompanying drawings. Additionally, the left most digit of a reference number identifies the drawing in which the reference number first appears. The accompanying drawings, which are incorporated in and constitute a part of this disclosure, illustrate various example embodiments. In the drawings:

DETAILED DESCRIPTION

Figure 1:
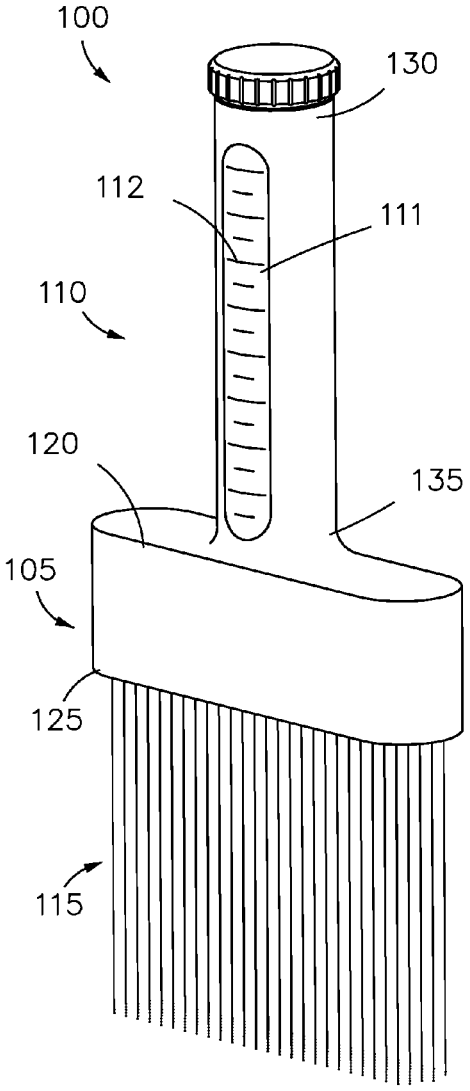
FIG. 1 is a perspective view of the brush, according to an example embodiment.

The following detailed description refers to the accompanying drawings. Wherever possible, the same reference numbers are used in the drawings and the following description to refer to the same or similar elements. While embodiments may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosed embodiments. Instead, the proper scope of the disclosed embodiments is defined by the appended claims.

The disclosed embodiments improve over the prior art by providing a self-moistening brush. The device also improves over the prior art by providing a more cost-effective means of decreasing the amount of paint thinner or thinning alternative required to keep the bristles of a brush moist. The device also decreases the amount of labor and cost to paint a surface area because the amount of coats required will be reduced. The device also provides a more efficient way to maintain the flex of the bristles of a brush. The device also prevents clogging and running of paint on the surface being painted allowing for a smoother finish. The device also increases the usable life of a paint brush.

Referring now to the Figures, FIG. 1 illustrates the paintbrush 100 according to one example embodiment. The paintbrush comprises a substantially rectangular shape hollow body 105 having an inside and an outside. The body has a first end 120 opposing a second end 125. Attached to the outside of the second end of the body is a plurality of elongated bristles 115. The plurality of bristles may be glued or affixed outside the second end of the body. In another embodiment (not shown), a hollow rectangular shaped body may be connected to the outside of the second end of the body. The hollow rectangular shaped body may be adapted to receive a portion of one end of the plurality of bristles. The hollow rectangular shaped body may also be formed from a material, such as aluminum or other composites etc., which is capable of being crimped or compressed slightly such that a portion of the plurality of bristles is held into place inside the hollow rectangular shaped body outside of the second end of the body. Glue may also be used to assist in maintaining one end of the bristles inside the hollow rectangular shaped body and attached to the outside of the second end of the body.

Attached to the first end of the body is a hollow handle 110 having an inside and outside. The handle defines an elongated tubular shaped hollow body having a first end or terminating end 130 opposing the second end 135 which is attached to the first end of the body. The handle and the body may be integral with each other or they may be affixed to each other with glue or some other type of coupling mechanism or device. The body and handle of the brush can be made from lightweight material, such as aluminum, metal composites, plastic etc., and shall be capable of holding fluid.

Figure 2:
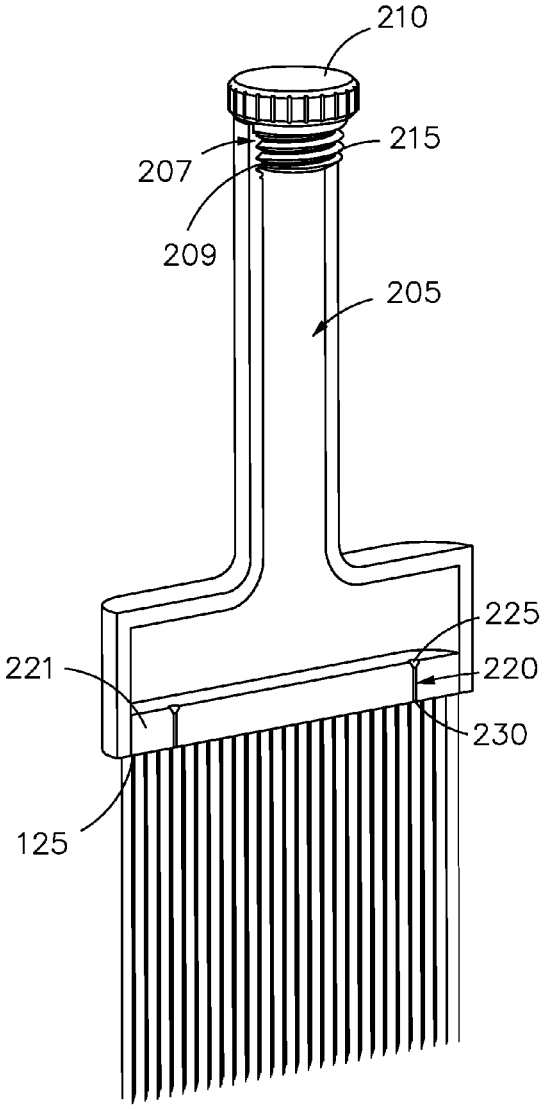
FIG. 2 is a partial cross-sectional perspective view of the brush, according to the example embodiment illustrated in FIG. 1.

FIG. 2 is a partial cross-sectional perspective view of the brush, according to the example embodiment illustrated in FIG. 1. FIG. 2 illustrates the inside of the hollow handle and body. The inside of the body and handle define a cavity 205. The size of the cavity may depend on the type of use that the paintbrush may be used for. For example, if a large surface area requires painting, then a user may desire a brush having a larger cavity so that a greater amount of fluid may held within the cavity. Similarly, the width of the brush and amount of bristles may also be sized based upon the amount of painting required. The cavity is adapted to receive fluid through an opening 207 in the terminating end of the handle. The size and shape of the opening may be varied. Proximate to the terminating end of the handle is a threaded portion 209 along the inside wall of the handle. The threaded portion of the inside wall of the handle is adapted for receiving and securing a removable cap 210. In the present embodiment, the removable cap comprises a cylindrical shaped body having a threaded portion 215 matching and corresponding to the threaded portion of the terminating end of the handle. Additionally, O-rings or seals may also be used to properly secure fluid from exiting the handle by the terminating end.

The cavity 205 is connected to the outside of the second end 125 of the body by at least one channel 220 that passes through a bottom wall 221 of the body 105. Each channel may be cylindrically shaped however other shapes may also be used. The channel has a first end 225 opposing a second end 230, the first end being proximate to the cavity 205 and the second end 230 being proximate to the bristles 115. The first end of the channel may also define a funnel shape, however the first end may also be adapted to define other shapes. The internal cross-sectional diameter of each channel may be sized and adapted for various uses. For example, the cross-sectional diameter of each channel may be between the range of 0.005 mm to 1 mm. However other ranges may also be used depending on the size of the body and amount of bristles. Furthermore, the amount of channels may vary depending upon the use or size of the brush. For example, brushes that are only 1 inch or smaller may only have one channel. In the present embodiment, two channels are disclosed. For larger brushes, channels may be spaced at approximately 1 inch apart and may include two or channels spaced approximately 1 inch apart from each other.

Referring to the operation of the brush, FIGS. 1 and 2 will be referenced. The removable cap 210 is removed and a fluid, such as kerosene, paint thinner, or some other petroleum-based product is inserted into the cavity 205 through the opening 207. After the fluid is inserted, the removable cap may be installed into the threaded portion 209 of the terminal or terminating end. While the brush is being used for painting (i.e. such as when downward strokes as well as when the brush is dipped into paint or other finishes or fluid to be applied), downward forces caused by gravity act on the fluid in the cavity 205 causing the fluid to pass through each channel 220 and out of the second end of the body 105 and into the plurality of bristles 115. As the fluid begins to seep or enter into the bristles, the bristles remain moist allowing a user the ability to more efficiently paint. The fluid also provides a smoother finish. Additionally, the fluid allow extends the life of the brush. Also worth noting, is that as shown in FIG. 1, an elongated peep hole 111 can be installed and is included along the handle so that a user can determine the level of fluid held within the cavity. The elongated peep hole may also include markings 112 of a unit of measurement along its body to assist the user in gauging the amount of fluid held within the cavity. The peep hole may be made of a transparent material such as hard plastic or glass.

In one embodiment, a portion of the handle 110 can comprise a resilient material. The resilient material is such that when the portion of the handle having the resilient material is squeezed or inward forces act upon it, the volume of the cavity 205 is decreased. This material can be a plastic or a type of polymer material that rebounds to its original shape after the inward forces are removed or when a user ceases squeezing the resilient material. Such plastics can include plastic resins of HDPE, LDPE, PET, and Polypropylene. When the volume defined by the cavity is decreased, the pressure within the cavity is increased. As the pressure within the cavity is increased, this causes the fluid within the cavity to flow out of each channel. This embodiment is useful because when a person is painting such that forces causing the fluid to flow out of the holes is not provided by gravity, a user can apply inward force or squeeze the resilient material of the handle. As such portion of the handle is squeezed, the inward force decreases the size of the volume of the cavity and thereby increasing the pressure inside of the cavity. As the pressure within the cavity is increased, such force causes the fluid inside of the cavity to flow out through each channel 220 of the second end 125 of the body and thereby moistening the plurality of bristles 115. In one embodiment the entire handle can comprise the resilient material. In other embodiments, less than the entire handle can comprise such resilient material.

Figure 3:
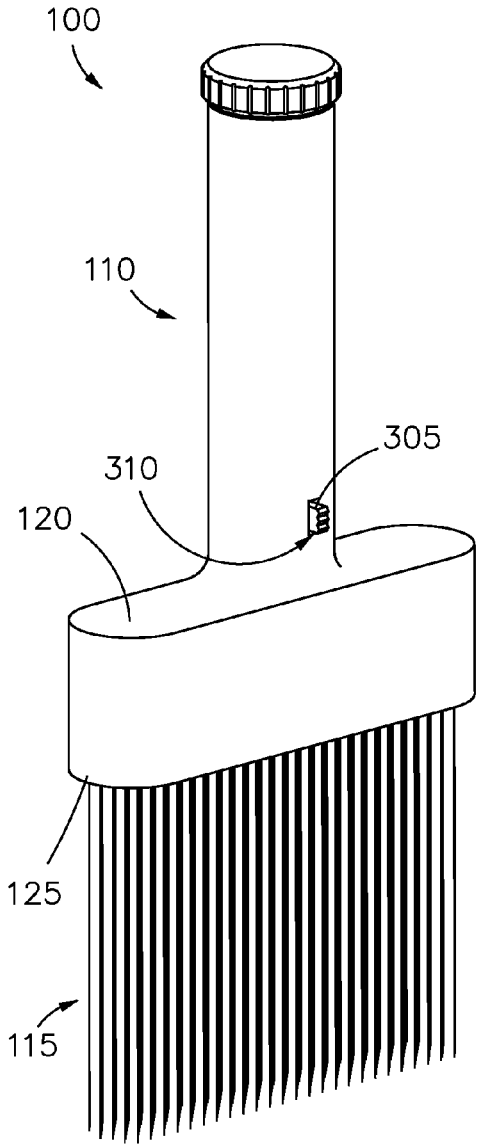
FIG. 3 is a perspective view of the brush, according to another example embodiment.
Figure 4:
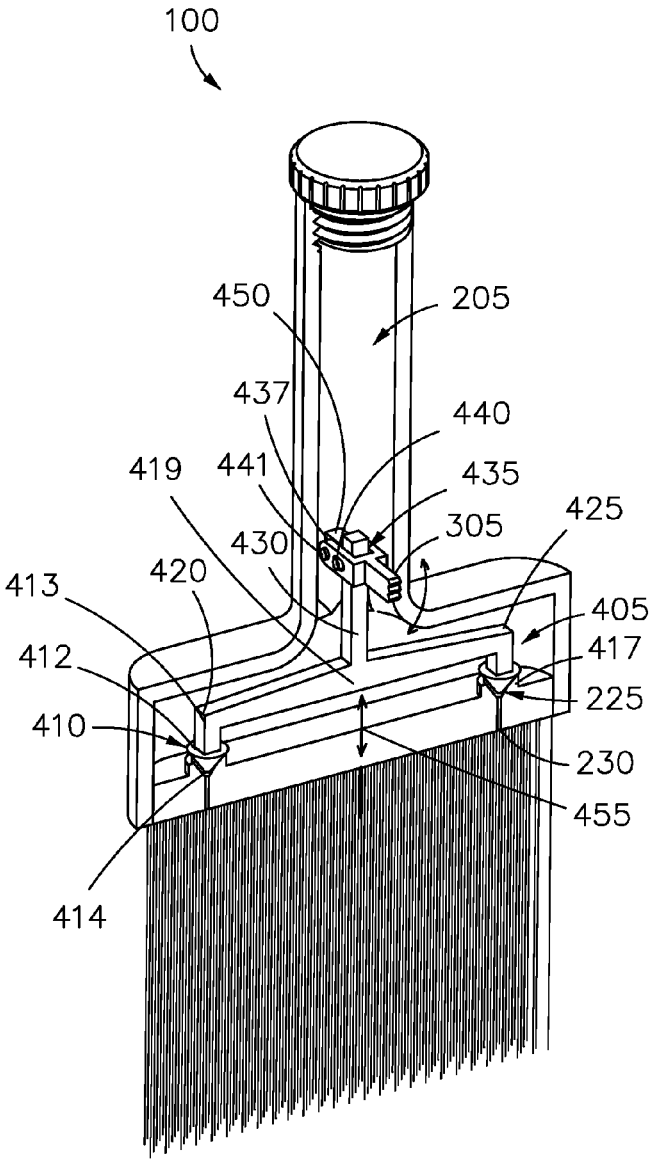
FIG. 4 is a partial cross-sectional perspective view of the brush, according to the example embodiment illustrated in FIG. 3.

FIGS. 3 and 4 are perspective views of an example embodiment of the present invention having a controlling device for controlling the flow of fluid through each of the channels 220. FIG. 3 illustrates a slot 310 adapted for allowing a protruding tab 305 of the controlling device to be operated from outside of the brush. In one embodiment, the protruding tab is a substantially rectangular shaped bar and the slot is adapted to allow the tab 305 to move up and down in the slot. A non-permeable membrane (not shown) covers the portion of the tab protruding beyond the outside surface of the handle 110 and is secured to a portion of the inside surface wall of the handle. The membrane or sealing device prevents fluid from flowing out of the opening or slot 310 while allowing a user to apply force to the tab in order to operate the controlling device.

FIG. 4 is a partial cross-sectional view of the brush having a controlling device 405 disposed within the cavity 205. In the present embodiment, the controlling device is adapted to control a flow of fluid from the cavity to the outside of the second end of the body 125 and into the plurality of bristles. The controlling device allows the user to stop flow of fluid from entering the bristles during use as well as during storage. The controlling device comprises at least one plug 410 for blocking a first end 225 of each channel. In the present embodiment, the plug 410 has a conical shaped body having a first end 412 opposing a second end 414. Each plug is adapted for being received by the funnel shaped feature 417 at the first end of each channel. The plug can be made of rubber, plastic, or any other material adapted for blocking openings. The invention includes a horizontal elongated bar 419 having a first end 420 opposing a second end 425. In the present embodiment, each end of the horizontal elongated bar 420, 425 also includes a downward arm 413 extending perpendicularly downward from the horizontal bar. However, in other embodiments (not shown) a downward arm may not be used. The first end of each plug 412 is connected to one of the downward arms. Attached proximate to the center of the horizontal elongated bar is a vertical elongated bar 430. The vertical bar can be a substantially rectangular shaped bar having a first end opposing a terminating end. The terminating end of the vertical bar is affixed to a channel 435 formed by a U-shaped member 437. The U-shaped member has a first end opposing a second end and comprises two opposing bar shaped members and a crossing member that spans from one opposing bar shaped member to the other. The tab 305 is coupled to the crossing member at the second end of U-shaped member. The tab is adapted to fit into the slot 310 and sized so that a portion of the tab can be accessed by a user when the brush is fully assembled as shown in FIG. 3. The channel is adapted for receiving the terminating end of the vertical bar. In the present embodiment, a bolt 440 pivotally connects the terminating end of the vertical bar to the U-shaped member. A second bolt 441 pivotally attaches a first end of the U-shaped member to a protruding feature 450 which is coupled to a portion of the inside surface of the handle. The U-shaped member attaches the terminating end of the vertical shaft to the protruding feature 450 in such a way that when force is applied along the direction of longitudinal line 455, the vertical bar 430 can translate up and down. When the vertical elongated bar translates or moves up-and-down, this causes each plug 410 to move up and down. When each plug is in the fully down or closed position, each plug blocks the first end 225 of a corresponding channel. The length of the slot 310 can be varied depending on the amount of up and down movement that is required for the controlling device to operate effectively.

Figure 5:
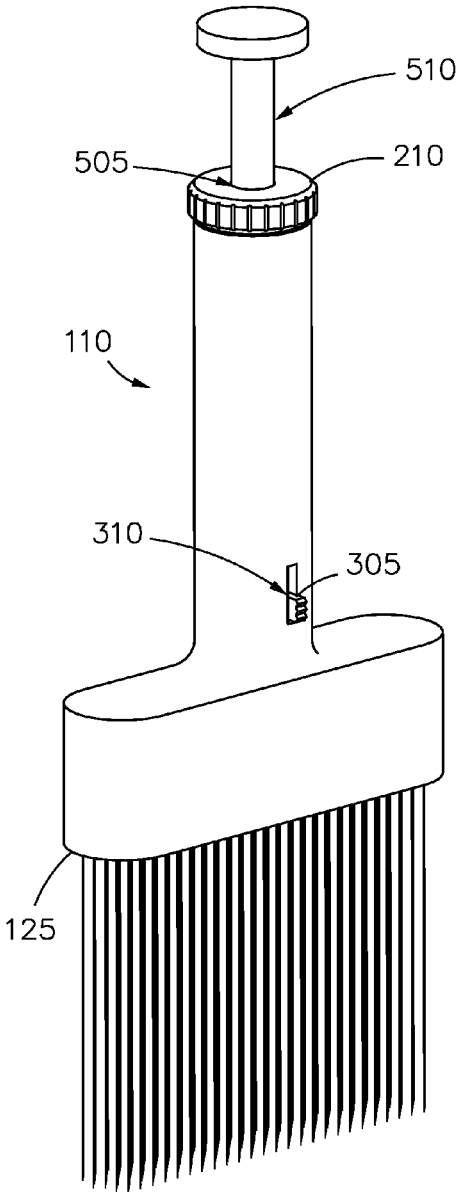
FIG. 5 is a perspective view of the brush, according to another example embodiment.
Figure 6:
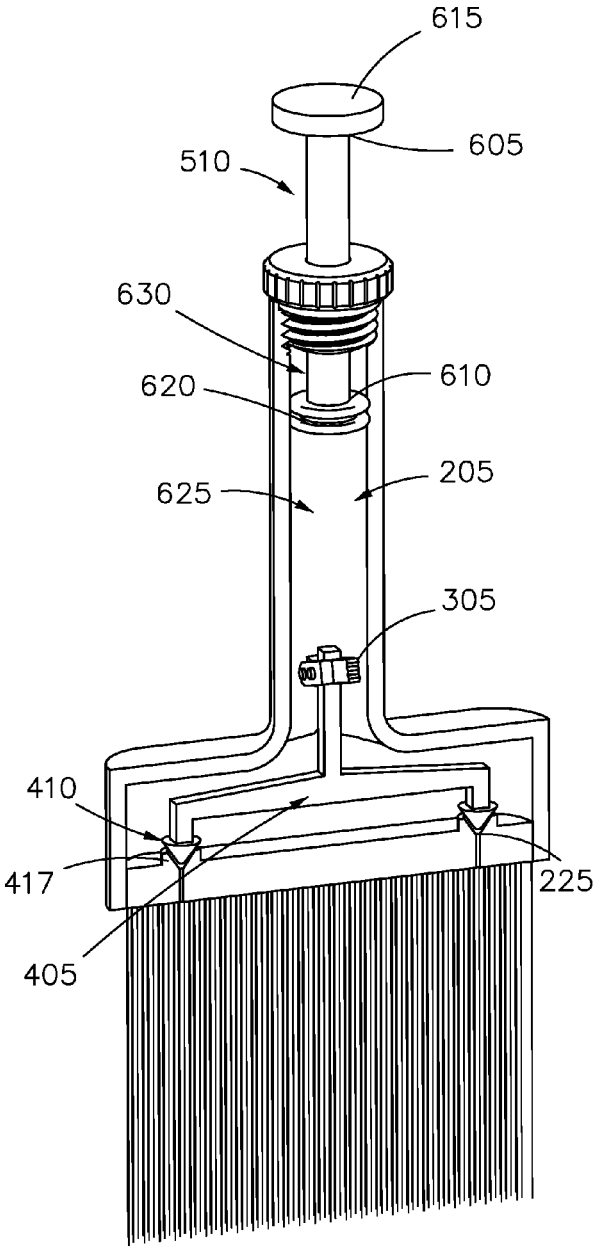
FIG. 6 is a partial cross-sectional perspective view of the brush having a controlling device in an open position, according to the example embodiment illustrated in FIG. 5.

FIGS. 5 and 6 are perspective views of another embodiment of the present invention. With noting is that FIGS. 5 and 6 have the same controlling device 405 as FIGS. 3 and 4. In FIG. 5, the portion of the tab 305 extending beyond the outside surface of the handle 110 is in a fully down or second position. In the fully down or second position, the tab 305 is positioned toward the bottom or second end 125 of the body of the brush. In this position, the plugs 410 have been fully received by the funnel shaped feature 417 and as a result the first end of each channel 225 is blocked. In this fully closed position, fluid is unable to exit the second end of the body and is retained within the cavity.

In FIG. 6, the controlling device 401 is in a fully open or up position. In the fully open or up position. The controlling device may also be moved between the open and closed position. In the fully open position, the portion of the tab 305 extending beyond the exterior surface of the handle is in the up or first position. When in the up or first position the tab is proximate to the top (not shown in FIG. 6 because FIG. 6 is a partial cross-sectional view) of the slot 310. When the controlling device is in the fully open position, the vertical and horizontal bars are also positioned upwards, which causes the plugs to be removed from the funnel shaped features 417 allowing fluid to flow into each channel and out of the second end of the body 125.

FIG. 5 also illustrates the removable cap 210. The present embodiment illustrates that that cap may also include an opening 505 adapted for receiving a plunger 510 and allowing the plunger to translate up and down within the inside of the handle 110.

FIG. 6 is a partial cross-sectional perspective view. In the present embodiment, the plunger can be an elongated cylindrical shaped body having a first end 605 opposing a second end 610. The first end of the plunger has a flange portion 615 that is adapted to allow a user to apply force in the longitudinal direction such that the plunger may move or translate up and down within the inside of the handle 110. The size and shape of the opening 505 is adapted to receive the shape of the body of the plunger. In the present embodiment, the plunger has a cylindrical shape, thus accordingly, the opening has a circular shape sized such that the cross-sectional diameter of the opening 505 is slightly larger than the cross-sectional diameter of the body of the plunger, which allows the body of the plunger to translate up and down within the inside of the handle 110. At the second end of the plunger is a sealing member 620. The sealing member may comprise a material, such as rubber or any other material used for sealing, and is sized such that it abuts the interior wall of the handle and creates a seal forming a forward chamber 625 inside the cavity 205 in front of the sealing member and a rear chamber 630 behind the sealing member.

To operate the embodiment shown in FIGS. 5 and 6, a user removes the removable cap 210. After removing the removable cap, a user can insert fluid into the opening 207. After fluid is inserted into the opening, the cap may be screwed back onto the terminating end 130 of the handle. If a user desires to increase the amount of flow of fluid exiting the second end 125 of the body, a user may apply force to the first end 605 of the plunger such that the body of the plunger 510 moves down into the cavity. As the plunger moves down into the cavity, the volume of the forward chamber 625 is decreased. As the volume of the forward chamber is decreased, the pressure within the forward chamber increases causing an increased flow of fluid out of the second end of the body (assuming the controlling device is in an open or up position). The plunger allows a user to control the amount of pressure within the forward chamber and provides a user with the ability to adjust the amount of flow out of the second end of the body and as a result a user is able to further control the moisture level of the bristles of the brush. If a user desires to decrease the flow of fluid out of the second end of the body, a user may increase the volume of the forward chamber 625 by pulling the plunger out of the cavity thereby increasing the volume of the forward chamber. Using the plunger in the above manner to keep the plurality of bristles moist allows for an increase in efficiency of the operation and cleaning of the brush by increasing the flow of fluid into the plurality of bristles thereby facilitating maintaining moisture in the brush bristles even when the downward force of gravity does not provide sufficient force to push fluid into the brush bristles.

Figure 7:
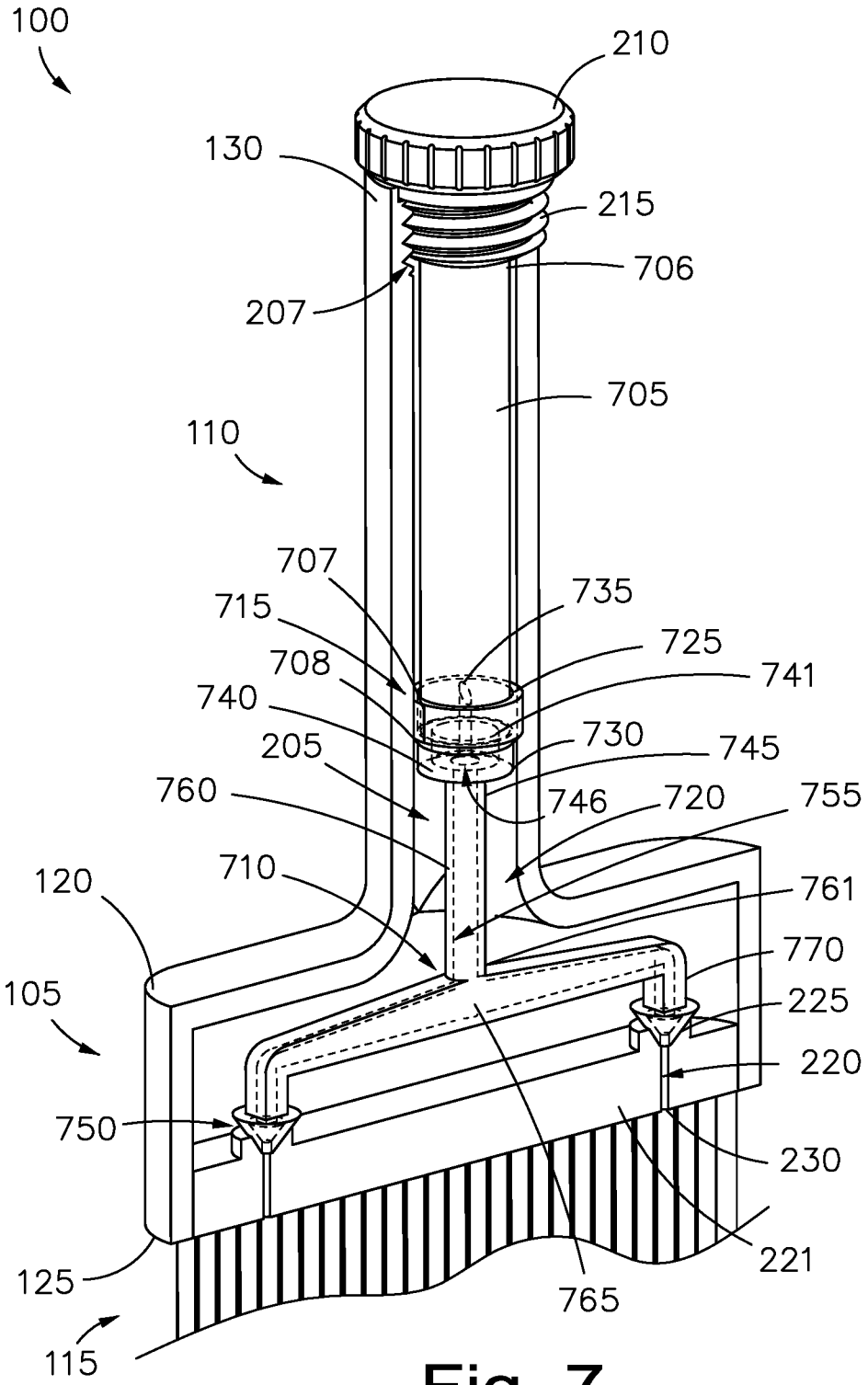
FIG. 7 is a partial cross-sectional perspective view of the brush, according to another example embodiment.

FIG. 7 illustrates a partial cross-sectional perspective view, in accordance with another embodiment of the invention. Similar to the previous embodiments, the present embodiment, includes a hollow body 105 having a first end 120 opposing a second end 125 and having an inside and an outside. As mentioned above, the body can be a substantially rectangular shape. The first end of the hollow body is connected to a hollow handle 110. The outside of the second end of the body is adapted for receiving a plurality of bristles 115. The handle can be a tubular shaped hollow body. A cavity 205 is defined by the inside of the body and the handle. The cavity is connected to the outside of the second end of the body by at least one channel 220. Similar to the above embodiments, the present embodiment also includes a removable cap 210 having a threaded section 215. The removable cap may be received by the terminating end 207 of the handle which has a threaded portion matching and corresponding to the threaded portion of the removable cap.

The invention also includes a removable capsule or cartridge 705. The removable capsule is adapted for being filled with and receiving a fluid. The cartridge is sized and shaped such that it is capable of being inserted through the opening 207 of the terminating end of the handle 130. The first end of the capsule 706 opposes a second end 707. The first end of the capsule may also include a handle or handling device (not shown) that allows a user to handle or maneuver the capsule and easily insert the capsule into the cavity 205 of the handle. In one embodiment, the handling device may comprise a collapsible handle coupled to the top of the capsule such that when the handle is collapsed the handle does not interfere with the closing of the opening 207 of the terminating end of the handle 110 of the brush. The capsule comprises material, such as plastic or a like material such that the second end 707 of the capsule can be punctured and therefore allowing fluid to flow out of the second end of the capsule.

The present embodiment also includes a channeling device 710 for channeling a flow of fluid from the capsule to outside the second end of the body 125. In the present embodiment, the channeling device 710 includes a top section 715 on top of a bottom section 720. The top section comprises a tubular element having an open or receiving end 725 opposing a second end 730. The receiving end defines a mouth adapted for receiving the bottom end 707 of the capsule. The receiving end may include a funnel shape (not shown) such that the second end of the capsule is guided into the mouth of the receiving end of the top section 715 of the controlling device. The top section may also include a flange portion defining a shoulder 708 such that a portion of the second end 707 of the capsule sits on the shoulder. At the second end of the top section is a bottom wall having a top surface 740. Extending perpendicularly upward from the top surface is a lumen 735. The lumen comprises material adapted for puncturing the material of the second end of the capsule 707. A cylindrical supporting element 741 surrounding the lumen may also be included to provide support to the lumen. The channel in the lumen provides a pathway through a bottom wall opening 746 to passageway 755 within the bottom section 720.

The bottom section 720 is connected below the top section. The bottom section may be integral with the top section 715 or the bottom section may be affixed to the top section by glue, welding, etc. The bottom section defines a body having a passageway 755 to each channel 220 such that after the lumen punctures the bottom end of the capsule, fluid from the capsule 705 may flow out through the second end 230 of the channel 220 and into the plurality of bristles.

In FIG. 7, the bottom section defines an elongated hollow neck 760. The elongated hollow neck is shaped like an elongated vertical bar having a first end 745 opposing a second end 761. The second end of the elongated neck is connected to an elongated hollow horizontal bar 765 having a hollow arm 770 extending downward at each opposing end that is in communication with each channel 220. The controlling device 710 allows the fluid to flow from inside the capsule 705 through the bottom wall of the body through the channel 220 and into the plurality of bristles.

Referring now to the operation of the embodiment illustrated in FIG. 7, a capsule 705 can be prefilled with fluid or fluid may be added into the capsule and then sealed before being inserted into the capsule into the cavity 205 through the opening 207 at the terminating end 130 of the handle. The bottom or second end 707 of the capsule is received by the receiving end 725 of the top section 715 of the controlling device 710. After the capsule has been inserted into the receiving end of the top section, sufficient downward force must be applied to the capsule such that the downward force causes a sharp edge of the lumen 735 to pierce the second end 707 of the capsule. After piercing the second end of the capsule, the fluid within the capsule can flow through the lumen and into the passageway 755 of the bottom section 720 and out through the channels 220 disposed along the bottom wall 221 of the body and into the plurality of bristles allowing the bristles of the brush to remain moist. When in use, the downward force of gravity that exists when the paint brush is held upright in a vertical position forces the fluid in the capsule to flow through the passageway 755 of the bottom section and through the channels 220 of the second end of the brush and into the plurality of bristles.

Figure 8A:
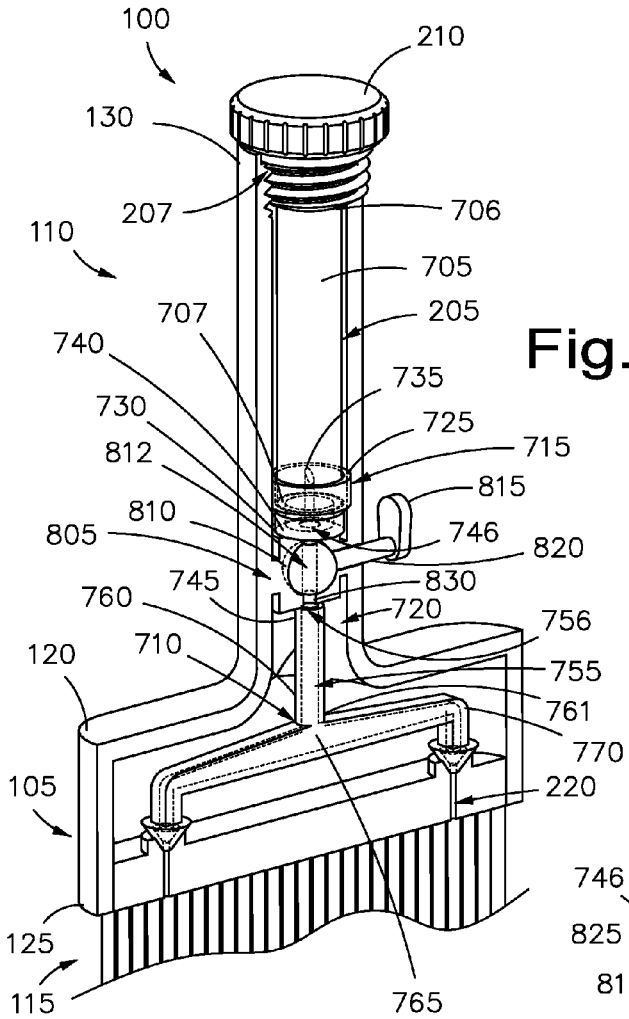
FIG. 8A is a partial cross-sectional perspective view of the brush having a controlling device in an open position, according to another example embodiment; and, FIG. 8B is a partial cross-sectional perspective view of the brush having a controlling device in a closed position, according to another example embodiment.
Figure 8B:
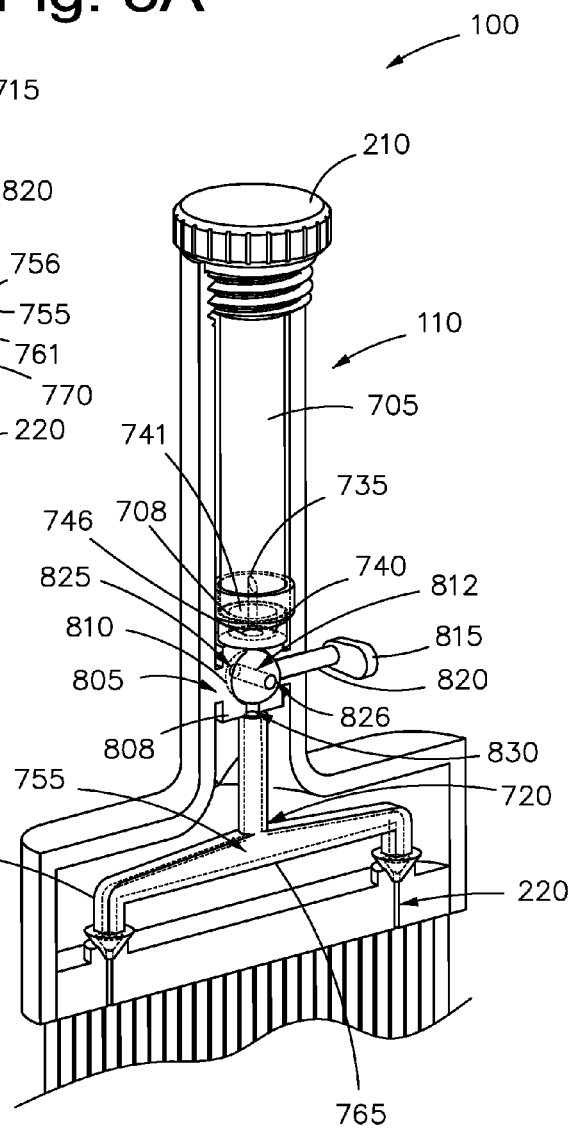

FIGS. 8A and 8B are partial cross-sectional perspective views, in accordance with another embodiment of the present invention. In FIGS. 8A and 8B, the controlling device 710 includes a ball valve 805 positioned below the top section 715 and above the neck 760 of the bottom section 720. In FIG. 8A, the ball valve is in the open position and in FIG. 8B the ball valve is in the closed position. As in FIG. 7, in FIGS. 8A and 8B the paint brush 100 has a hollow body 105 having a substantially rectangular shape connected to an elongated hollow handle 110. The body has a first end 120 opposing a second end 125. Connected to the outside of the second end of the body is a plurality of bristles 115. A removable cap 210 is adapted for being received by the opening 207 of the terminating end 130 of the handle. As in FIG. 7, in FIGS. 8A and 8B, the embodiment includes a removable capsule 705 having a first end 706 opposing a second end 707, the capsule being adapted for insertion into the cavity 205 of the handle 110.

Similar to the embodiment in FIG. 7, the embodiment illustrated in FIGS. 8A and 8B includes a controlling device 710 having a top section 715 and a bottom section 720. The top section comprises a tubular element having a receiving end 725 opposing a second end 730. The receiving end defines a mouth adapted for receiving the bottom end 707 of the capsule. The receiving end may include a funnel shape such that the second end of the capsule is guided into the mouth of the receiving end of the top section 715 of the controlling device. As in FIG. 7, in FIGS. 8A and 8B, the top section may also include a flange portion defining a shoulder 708 such that a portion of the second end 707 of the capsule sits on the shoulder. At the second end of the top section is a bottom wall having a top surface 740. Extending perpendicularly upward from the top surface is a lumen 735. The lumen comprises material adapted for puncturing the material of the second end of the capsule 707. The lumen may be comprised from steel, aluminum, etc. and has a sharp edge adapted for puncturing. Similar to FIG. 7, in FIGS. 8A and 8B, a cylindrical supporting element 741 surrounding the lumen may also be included to provide support to the lumen. The channel in the lumen provides a pathway through a bottom wall opening 746 and into the ball valve 805.

The ball valve includes a rotatably mounted sphere 810 held within a ball valve housing 808. The sphere has a cylindrically shaped channel 812 spanning the diameter of the sphere having a first sphere channel opening 825 opposing a second sphere channel opening 826. The ball valve housing includes a ball valve housing top opening (not shown) and an opposing ball valve housing bottom opening 830, which align with the opening 746 in the bottom wall of the top section and the opening 756 at the first end 745 of the neck 760 to the passageway 755, respectively.

FIG. 8A illustrates the ball valve in the open position such that fluid can flow from the capsule 705 and into the hollow neck 760. In the open position, the cylindrically shaped channel 812 of the sphere is aligned such that the first sphere channel opening 725 aligns with the ball valve housing top opening (not shown) and the second sphere channel opening 826 aligns with the ball valve housing bottom opening 830. The sphere can be rotated from the open position to a closed position by a stem 820 affixed to a portion of the outside surface of the sphere 810. The stem is positioned such that it passes through an opening along the side of the handle 110. Attached to terminating end of the stem is a handle 815 which can be used by a user to apply rotational force to the stem.

FIG. 8B illustrates the ball valve 805 in a closed position. In the closed position, the sphere is positioned such that the openings 825, 826 of the cylindrically shaped channel 812 are not aligned with the top and bottom ball valve housing openings. In this position, fluid is unable to pass from the capsule 705 and into the hollow neck of the bottom section 720.

In FIGS. 8A and 8B, the bottom section 720 defines an elongated hollow neck 760. The elongated hollow neck is shaped like an elongated hollow vertical bar having a first end 745 opposing a second end 761. The second end of the elongated neck is connected to an elongated hollow horizontal bar 765 having a hollow arm 770 extending downward at each opposing end, wherein the passageway within each hollow arm is in communication with each channel 220.

Referring now to the operation of the embodiment illustrated in FIGS. 8A and 8B, the removable capsule 705 includes a fluid therein. As mentioned above, the removable capsule may prefilled with fluid or a user may fill the capsule will fluid and then secure the opening through which the fluid was inserted. The capsule may then be inserted into the cavity 205 of the body 110. After inserting the capsule into the cavity 205, a user may apply downward forces to the top end 706 of the capsule sufficient enough for a sharp edge of the lumen 735 to pierce the material comprising the bottom end 707 of the capsule. Next, the user may secure the removable cap 210 onto the first or terminating end 130 of the handle. If a user desires fluid to flow from the capsule to the plurality of bristles, then the user will position the ball valve in the open position as shown in FIG. 8A. In the open position, the cylindrically shaped channel 812 is aligned such that the openings 825, 826 align with the top and bottom openings of the ball valve housing. In this position, the fluid can flow from the capsule and into the passageway 755 of the bottom section 720 of the controlling device and then out through the channels 220 and into the plurality of bristles, thereby moistening the bristles. If a user desires to stop the flow from the capsule to the bristles, then the user may apply rotational forces to the handle 815 such that the stem rotates and thereby rotates the sphere from the open position to the closed position such that the cylindrically shaped channel 812 is not aligned with the top and bottom openings of the ball valve housing. In the closed position, the fluid is prevented from passing through the ball valve. The ball valve allows a user to further control the amount of fluid that enters into the plurality of bristles.

The ball valve is well known to those skilled in the art. Additional embodiments of the ball valve are also contemplated within the scope of the present invention. Furthermore, other valves may also be used to control the flow from the top section to the bottom section of the controlling device. To assemble the various embodiments described herein, the brush may be assembled in two parts such that the various components of the controlling device may be inserted into the hollow portions of a first part of the brush after which the second part of the brush may be affixed to the first part of the brush thereby enclosing and forming the cavity. Additionally, support members (not shown) may also be included within the hollow brush such that it supports the various components of the controlling device, valve etc.

The components of the controlling device may be formed from various materials, such as light weight metals, composites, plastics, etc. Additionally, the bristles may modified depending on the desired use of the brush. The various components of the brush may be integral with one another or the components may modular and affixed to one another using methods known to those skilled in the art. Various seals and sealing devices may provide additional seals at the openings in the invention.

The subject matter has been the shape described in language specific to structural features and/or methodological acts to be understood that the subject matter defined in the appended claims is not necessarily limited to the specific features or acts described above. Rather, the specific features and acts described above are disclosed as example forms of implementing the claims.

What is claimed is:

1. A paint brush comprising:

a hollow body having a first end opposing a second end and an inside and an outside;

a hollow handle having an inside and an outside, wherein the first end of the body is connected to the handle, and wherein the outside of the second end of the body is adapted for receiving a plurality of bristles;

a plurality of bristles attached to the outside of the second end of the body;

a cavity defined by the inside of the body and handle, the cavity being connected to the outside of the second end of the body by at least one channel, wherein the cavity is adapted to receive fluid, wherein the fluid comprises a solvent having lower viscosity than paint such that the bristles remain moist during painting given that the solvent seeps through at least one channel; and a removable cap covering an opening at a terminating end of the handle.

2. The paint brush of claim 1, wherein the cavity is adapted to receive fluid though an opening at the terminating end of the handle.

3. The paint brush of claim 2, wherein the brush further comprises a controlling device for controlling a flow of fluid from the cavity to the outside of the second end of the body.

4. The paint brush of claim 3, wherein the controlling device comprises at least one plug for blocking a first end of a corresponding channel and controlling the flow of fluid from the cavity to outside of the second end of the body, wherein each plug has a first end opposing a second end, and wherein the first end of each plug is connected to an elongated horizontal bar, wherein the elongated horizontal bar is coupled to an elongated vertical bar, wherein the elongated vertical bar is movably connected to a first end of a U-shaped member, wherein the first end of the U-shaped member is movably connected to a protruding feature of the inside wall of the cavity, and wherein a second end of U-shaped member is connected to a tab.

5. The paint brush from claim 4, wherein the controlling device has an open position and a closed position, wherein in the closed position each plug blocks a channel preventing the flow of fluid from the cavity to outside of the second end of the body and the plurality of bristles, and in the open position each plug does not prevent the flow of fluid from the cavity to outside the second end of the body and the plurality of bristles.

6. The paint brush from claim 5, wherein a portion of the tab protrudes beyond the outside surface of the handle through a slot in the handle, wherein forces acting on the tab can move the tab between a first position to a second position, and wherein in first position the controlling device is in the open position and in the second position the controlling device in the closed position.

7. The paint brush of claim 2, wherein the paint brush further includes a plunger having a body comprising a first end opposing a second end, wherein the second end of the plunger body is disposed within the cavity and is adapted such that the body of the plunger translates within an opening in the removable cap, wherein the plunger is adapted for increasing the flow of fluid to the plurality of bristles.

8. The paint brush of claim 2, wherein each channel has a cross-sectional diameter between the range of 0.005 mm and 1 mm.

9. The paint brush of claim 2, wherein the paint brush has two channels and wherein each channel is approximately one inch apart from each other.

10. The paint brush of claim 1, wherein the paint brush further includes an elongated peep hole adapted for viewing the level of fluid within the cavity.

11. The paint brush of claim 1, wherein a portion of the handle comprises a resilient material such that an inward force acting on such material causes a volume defined by the cavity to be decreased such that a pressure within the cavity is increased such that a flow of fluid to each channel is increased.

12. A paint brush comprising:

a hollow body having a first end opposing a second end and an inside and an outside;

a handle having an inside and an outside, wherein the first end of the body is connected to the handle, and wherein the outside of the second end of the body is adapted for receiving a plurality of bristles;

a plurality of bristles attached to the outside of the second end of the body;

a cavity defined by the inside of the body and handle, the cavity being connected to the outside of the second end of the body at least two channels;

a removable cap covering an opening at a terminating end of the handle;

a controlling device for controlling a flow of fluid from the cavity to outside the second end, wherein the controlling device comprises a plug for blocking a first end of each channel and controlling the flow of fluid from the cavity to outside of the second end of the body, wherein an elongated vertical bar is movably connected to a first end of a U-shaped member, wherein the first end of the U-shaped member is movably connected to a protruding feature of the inside wall of the cavity, and wherein a second end of the U-shaped member is connected to a tab, wherein the controlling device has an open position and a closed position, wherein in the closed position each plug blocks a channel preventing the flow of fluid from the cavity to the plurality of bristles, and in the open position the plug does not prevent the flow of fluid from the cavity to the plurality of bristles.

13. The paint brush of claim 12, wherein the cavity is adapted to receive fluid though the opening at the terminating end of the handle.

14. The paint brush of claim 13, wherein a portion of the tab protrudes beyond an outside surface of the handle, and wherein forces acting on the tab can move the tab between a first position to a second position, wherein in first position the controlling device is in the open position and in the second position the controlling device in the closed position.

15. The paint brush of claim 12, wherein the paint brush further includes a plunger having a body having a first end opposing a second end, wherein the second end is disposed within the cavity and the body of the plunger moves through an opening in the cap, wherein the plunger is adapted for increasing the flow of fluid to the plurality of bristles.

16. The paint brush of claim 12, wherein each channel has a cross-sectional diameter between the range of 0.005 mm and 1 mm.

17. The paint brush of claim 12, wherein the paint brush has two channels spaced approximately one inch apart from each other.

* * * * *